US007497345B2

(12) United States Patent
Brabb et al.

(10) Patent No.: US 7,497,345 B2
(45) Date of Patent: Mar. 3, 2009

(54) APPARATUS FOR RAILWAY FREIGHT CAR COUPLER KNUCKLE

(75) Inventors: David C. Brabb, Chicago, IL (US); Harish K. Kandoth-Kannoth, Woodridge, IL (US); Anand R. Vithani, Addison, IL (US)

(73) Assignee: Sharma & Associates, Inc., Countryside, IL (US)

( * ) Notice: Subject to any disclaimer, the term of this patent is extended or adjusted under 35 U.S.C. 154(b) by 171 days.

(21) Appl. No.: 11/583,517

(22) Filed: Oct. 18, 2006

(65) Prior Publication Data

US 2007/0084818 A1 Apr. 19, 2007

Related U.S. Application Data

(60) Provisional application No. 60/728,021, filed on Oct. 18, 2005.

(51) Int. Cl.
*B61G 3/00* (2006.01)

(52) U.S. Cl. ..... 213/100 R; 213/104; 213/109; 213/154

(58) Field of Classification Search ..... 213/100 R, 213/101–104, 109, 154, 155
See application file for complete search history.

(56) References Cited

U.S. PATENT DOCUMENTS 2,162,390 A * 6/1939 Rydin ..... 213/104
2,250,993 A * 7/1941 Kinne et al. ..... 213/154
2,797,821 A * 7/1957 Blattner ..... 213/154
2,920,771 A * 1/1960 Kulieke ..... 213/154
3,606,032 A * 9/1971 DePenti et al. ..... 213/152
3,693,809 A * 9/1972 Metzger ..... 213/100 R
3,854,599 A * 12/1974 Day et al. ..... 213/100 R
4,391,380 A * 7/1983 Hoose ..... 213/76
4,984,696 A * 1/1991 Altherr ..... 213/151
2006/0037497 A1 * 2/2006 da Cruz Baptista ..... 100/213
2007/0084818 A1 * 4/2007 Brabb et al. ..... 213/100 R

* cited by examiner

*Primary Examiner*—S. Joseph Morano
*Assistant Examiner*—Jason C Smith
(74) *Attorney, Agent, or Firm*—James Ray & Assoc.

(57) ABSTRACT

In combination with a railway freight car coupler. A coupler has a knuckle side, and includes a knuckle, knuckle pin, and an apparatus for automatically pivoting and maintaining the knuckle full open position. The improvement comprises a coiled torsion spring which is capable of continuously exerting a predetermined force. A sleeve in combination with a flange is secured to the bottom end of the knuckle pin for attaching the torsion spring onto the coupler head. A support member is attached to the knuckle and cages one arm of the torsion spring which exerts a continuous force on the knuckle to rotate and maintain the knuckle full open position. A compression spring may be employed in place of the torsion spring in combination with a locking mechanism which, rigidly secures the knuckle and knuckle pin therebetween to prevent independent movement.

13 Claims, 3 Drawing Sheets

APPARATUS FOR RAILWAY FREIGHT CAR COUPLER KNUCKLE

CROSS-REFERENCE TO RELATED APPLICATIONS

This application is related to and claims priority from Provisional Patent Application Ser. No. 60/728,021 filed Oct. 18, 2005.

FIELD OF INVENTION

The present invention relates, in general, to a railroad freight car coupler knuckle, and more particularly, to an apparatus for a railroad freight car coupler knuckle to automatically pivot and maintain the knuckle in the full open position.

BACKGROUND OF THE INVENTION

As is generally well known, all railroad freight cars are coupled together by mechanical couplers. The coupler consists of a coupler body, knuckle, and knuckle pin. To couple two cars, at least one of the coupler knuckles must be in the full open position. When contact between the knuckles is made, the coupling force will close the full open knuckle or knuckles. Freight car coupling systems are well known in the art. Several coupling system manufacturers include McConway & Torley, American Steel Foundries, and Columbus Steel Castings. Prior to the present invention, a member of the train crew must physically open at least one knuckle before attempting to couple the cars. If at least one of the knuckles is not fully open, the coupling might not occur, but rather, the knuckles and couplers might make forcible contact. This contact will ultimately result in costly damage to the couplers and coupling systems.

SUMMARY OF THE INVENTION

In a first aspect, the present invention provides, in combination with a railway freight car coupler having a knuckle side and a guard arm side, and further including a knuckle and knuckle pin, an apparatus for automatically pivoting and maintaining the full open position of the coupler knuckle when an uncoupling mechanism is actuated. The improvement comprises a coiled torsion spring capable of continuously exerting a predetermined force. Attachment means is provided for attaching the coiled torsion spring to a first portion of such coupler head. Connecting means is provided for connecting a first arm of the torsion spring to such knuckle generating a torque on such knuckle to pivot and maintain the full open position of such knuckle.

In a second aspect, the present invention provides, in combination with a railway freight car coupler having a knuckle side and a guard arm side, and further including a knuckle and knuckle pin, an apparatus for automatically pivoting and maintaining the full open position of the coupler knuckle when an uncoupling mechanism is actuated. The improvement comprises a locking means which rigidly secures such knuckle to such knuckle pin to prevent such independent rotation of such knuckle relative to such knuckle pin. This permits simultaneous rotational motion of the knuckle and the knuckle pin. A fixed support member is rigidly attached to such coupler head. A pivot member is securely attached to such knuckle pin for a simultaneous rotation therewith. A compression member has a first end and a second end. The first end is disposed on the fixed support member enabling the compression member to exert a continuous force onto the pivot member. This generates a torque on such knuckle pin and such knuckle to rotate and maintain the full open position of such knuckle.

OBJECTS OF THE INVENTION

It is therefore the primary objective of the present invention to provide an apparatus for automatic pivoting and maintaining the full open position of a railway freight car coupler knuckle when the uncoupling mechanism is actuated.

Another object of the invention is to eliminate the dangerous and hazardous routine of train personnel walking between railcars to manually open the knuckles.

Another object of the invention is to minimize damage to couplers and knuckles due to impact during coupling as a result of an unopened or partially opened coupler knuckle.

Another object of the invention is to provide an apparatus for automatic pivoting and maintaining the full open position of a railway freight car coupler knuckle that can be retrofitted on existing coupler systems.

An additional object of the invention is to provide an apparatus for automatic pivoting and maintaining the full open position of a railway freight car coupler knuckle that helps to provide a maximum gathering range.

A still further object of the invention is to provide an apparatus for automatic pivoting and maintaining the full open position of a railway freight car coupler knuckle that does not interfere with normal operations of the coupler when added thereto.

In addition to the various objects of the invention that have been described above, various other objects and advantages of the invention will become more readily apparent to those persons skilled in the relevant art from the following more detailed description of the invention, particularly, when such description is taken in conjunction with the attached drawing figures and appended claim.

Figure 1:
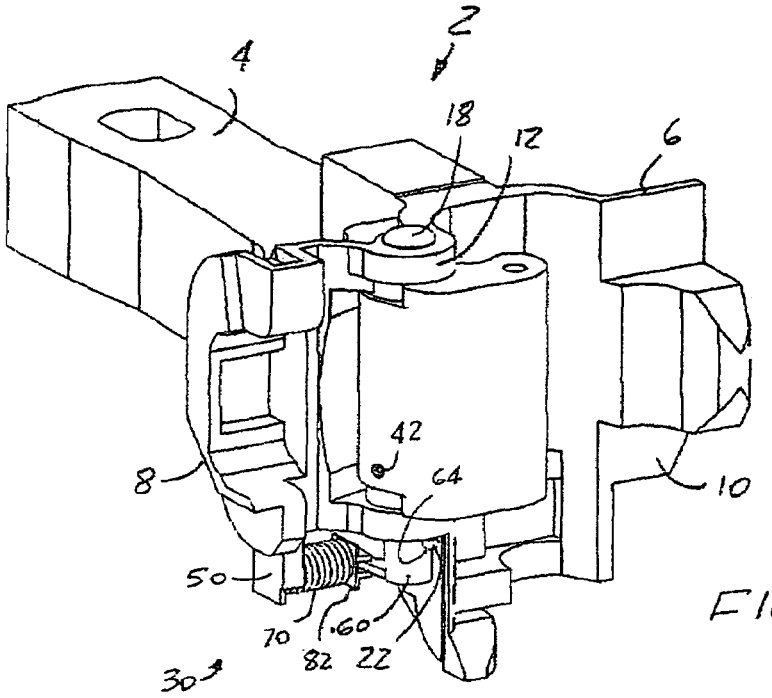
FIG. 1 is a perspective view of a railway freight car coupler assembly with the improvement apparatus for automatically pivoting and maintaining the full open position of the coupler knuckle which is constructed according to one embodiment of the invention.

BRIEF DESCRIPTION OF A PRESENTLY PREFERRED AND VARIOUS ALTERNATIVE EMBODIMENTS OF THE PRESENT INVENTION

Prior to proceeding to a more detailed description of the invention, it should be noted that identical components having identical functions have been designated with identical reference numerals for the sake of clarity.

Now refer more particularly to FIGS. 1-6 of the drawings. Illustrated therein is a railway freight car coupler, generally designated as 2. The coupler assembly 2 includes a shank portion 4 and a coupler head 6 which has a knuckle side 8 and a guard arm side 10. The coupler head 6 further includes a pair of bifurcated members 12 each having an aperture 14 for receiving a generally cylindrical knuckle pin 16. The knuckle pin 16 has a mushroomed head 18 engageable with an upper bifurcated member 12 and an aperture 20 formed in the bottom end of the knuckle pin 16 for receiving a conventional cotter pin 22. A knuckle 24 is mounted for independent rotation on the knuckle pin 16 by way of the longitudinal aperture 26 and is caged between the pair of bifurcated members 12.

In combination with the coupler assembly 2, FIGS. 1-6 illustrate an improvement which includes an apparatus, generally designated as 30, for automatically pivoting and maintaining the full open position of the knuckle 24 of the coupler assembly 2 when an uncoupling mechanism (not shown) is actuated. Further details of the uncoupling mechanism are not provided because uncoupling mechanisms are well known in the art.

Figure 2:
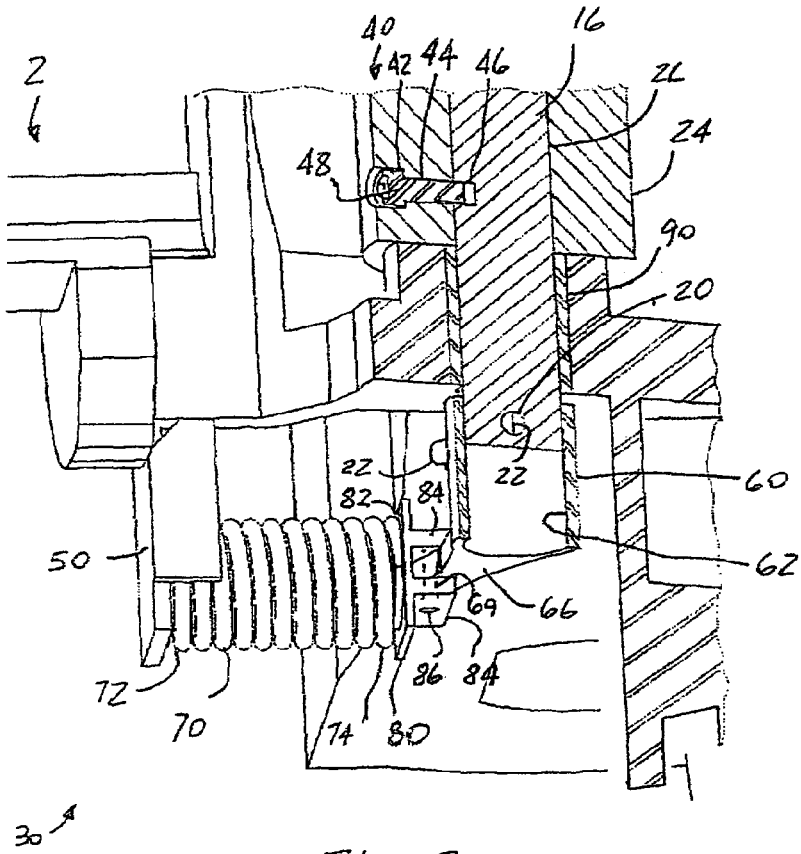
FIG. 2 is partially cross-sectional view of the coupler assembly with the improvement apparatus of FIG. 1, particularly illustrating the attachment of the apparatus to the coupler.
Figure 3:
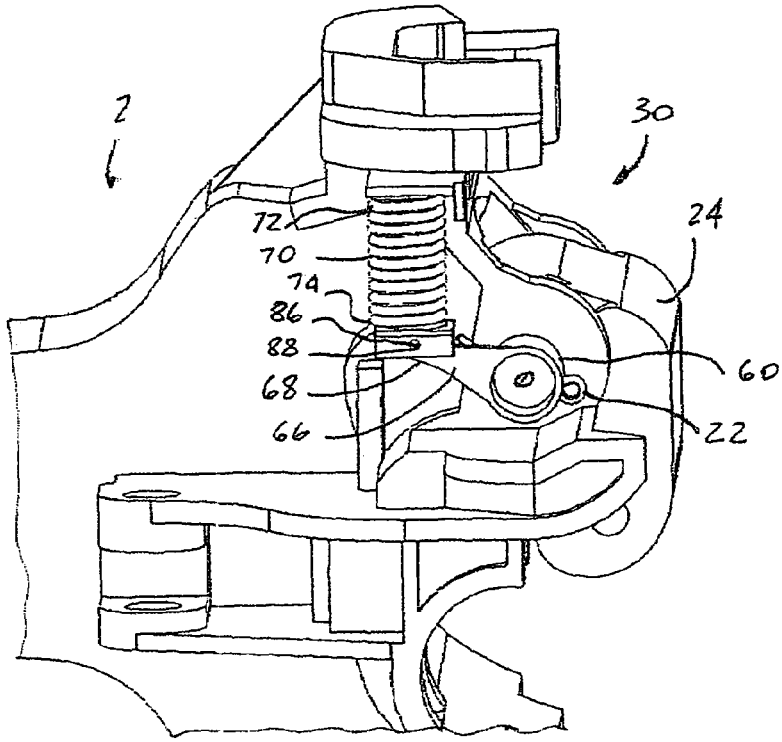
FIG. 3 is a coupler bottom view illustrating the improvement apparatus and the coupler knuckle in the closed position.

According to a first embodiment of the invention, best shown in FIGS. 1-4, the improvement apparatus 30 includes a locking means, generally designated as 40 and best shown in FIG. 2, for rigidly securing such knuckle 24 to such knuckle pin 16 in order to prevent such independent rotation of such knuckle 24 relative to such knuckle pin 16, thus permitting simultaneous rotational motion of such knuckle 24 and such knuckle pin 16. It is presently preferred that such locking means 40 includes a locking aperture 42 which extends from the outer surface of the knuckle 24 to the wall of the aperture 26 and which has a longitudinal axis thereof disposed perpendicular to a longitudinal axis of such aperture 26 and such knuckle pin 16. The locking aperture 42 has a predetermined shape and has a threaded portion 44. There is a cavity 46 which is formed within the locking pin 16 and in alignment with the locking aperture 42 when such knuckle 24 is mounted onto such locking pin 16. A threaded fastener 48 threadably engages such threaded portion 44 of the locking aperture 42 and has a free end thereof disposed within the cavity 44 for locking the knuckle 24 onto the knuckle pin 16.

The improvement apparatus 30 further includes a support member 50 which is rigidly fixed to the knuckle side 8 of the coupler head 6 and extends generally downwardly from the coupler head 6. Preferably, the support member 50 is fixed to the knuckle side 8 by a welding method which is advantageous for retrofitting the existing coupler assemblies 2. However, it will be understood that other conventional attachment methods may be employed in the present invention. Furthermore, on new coupler assemblies 2, such support member 50 may be formed integral to the knuckle side 8.

A pivot member 60 is rigidly attached to the knuckle pin 16 for a simultaneous rotation therewith. The pivot member 60 has a tubular shape with an interior portion 62 being sized to encircle the outer surface of the knuckle pin 16 with a predetermined clearance which is sufficient to prevent undesirable movement of the pivot member 60 relative to the knuckle pin 16 and which enables ease of installation of such pivot member 60 onto the knuckle pin 16. Advantageously, the pivot member 60 is adapted with an aperture 64 which is aligned with an aperture 20 of the knuckle pin 16 for attaching the pivot member 60 onto the knuckle pin 16 with the conventional cotter pin 22. The pivot member 60 has an arm 66 which is disposed generally perpendicular to the longitudinal axis of the knuckle pin 16.

The improvement apparatus 30 additionally includes means for exerting a continuous and a predetermined force onto the pivot member 60, thus generating a torque on such knuckle pin 16 and such knuckle 24, when an uncoupling mechanism is activated, to rotate and maintain full open position of such knuckle 24. In this embodiment, such force exerting means is a compression member, such as spring 70 having a predetermined rate, which has a first end 72 disposed on the support member 50 and a second end 74 which engages the free end 68 of the arm 66 of the pivot member 60.

Optionally, the improvement apparatus 30 may include a movable support member 80 which has a connecting end 82 disposed on the second end 74 of the compression member 70, and a pivoting means which engage the free end 68 of the arm 66 of the pivot member 60. By way of example, such pivoting means is shown in FIG. 2 as a pair of spaced members 84 caging the free end 68 of the arm 66 and having an aperture 86 vertically aligned with an aperture 69 in the free end 68 for receiving a conventional cotter pin 88 for ease of assembly.

In operation, when the coupling mechanisms (not shown) are coupled, the knuckle 24 closes, thus compressing the compression spring 70, which in turn stores the energy. When a conventional lock (not shown) employed with the coupler assembly 2 is lifted for uncoupling operation and the couplers move apart, the stored energy in the spring 70 opens the knuckle 24 to its full open position, best shown in FIG. 4, and maintains it in such position, making it ready for next coupling operation.

To reduce the frictional forces during simultaneous rotation of the knuckle pin 16 and knuckle 24, the improvement apparatus may include an optional bearing means 90, such as a pair of well known sleeve bearing 90, each disposed within an aperture 16 of the bifurcated member 14, as best shown in FIG. 2. Preferably, the sleeve bearings 90 are mounted on the knuckle pin 16 to reduce the retrofit effort of the apertures 16 which are generally elongated in one direction.

Furthermore, it will be apparent to those skilled in the art that the compression spring 70 may be replaced with an elastomeric member (not shown) capable of storing and releasing energy to rotate and maintain the knuckle 24 in the fully open position.

It will be appreciated that the improvement apparatus 30 constructed according to the first embodiment of the invention can be easily retrofitted on existing coupler systems and does not interfere with normal operations of the coupler when added thereto.

Figure 4:
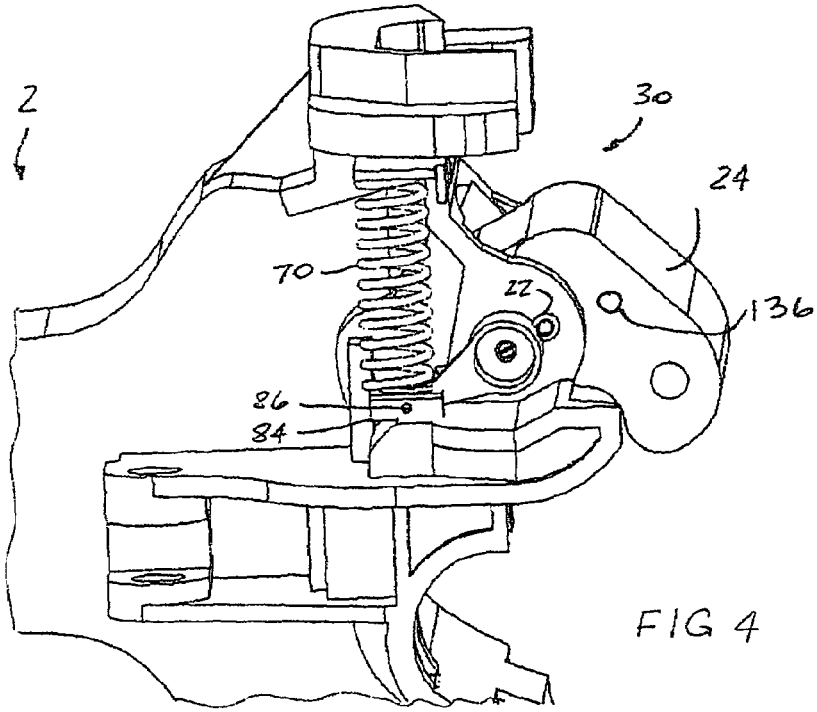
FIG. 4 is a coupler bottom view illustrating the improvement apparatus and the coupler knuckle in the open position.
Figure 5:
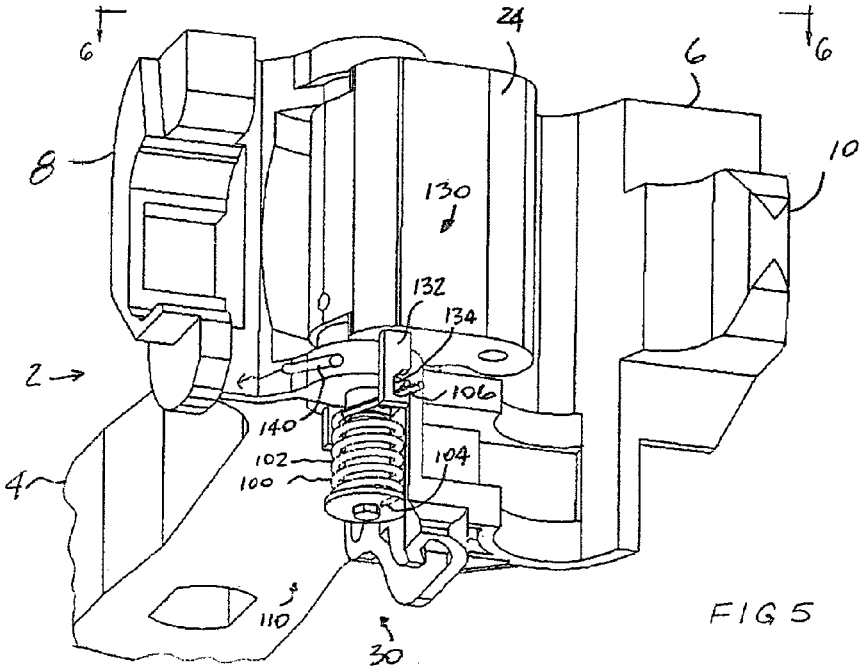
FIG. 5 is a perspective view of a railway freight car coupler assembly with the improvement apparatus for automatically pivoting and maintaining the full open position of the coupler knuckle which is constructed according to another embodiment of the invention.

According to a second embodiment, best shown in FIGS. 4-5, the improvement apparatus 30 includes a coiled torsion spring 100 capable of continuously exerting a predetermined force. The coiled torsion spring 100 has a coiled main portion 102, a first arm 104 which extends outwardly from one end of the coiled portion 102 and a second arm 106 which extends outwardly from an opposed end of the coiled portion 102.

The improvement apparatus 30 according to the second embodiment of the invention, also includes means, generally designated as 110, for attaching the coiled torsion spring 100 to a first portion of such coupler head 6 and, more particularly, to the knuckle side 8. Such means 110 includes an elongated sleeve member 112 which coaxially engages a bottom end of such knuckle pin 16 at one end. A threaded aperture 114 is axially formed in such bottom end of such knuckle pin 16. A flange member 118 abuts a bottom end of the elongated sleeve member 112. A threaded fastener 120 threadably engages the threaded aperture 114 for attaching the flange member 118 to such bottom end of such elongated sleeve member 112. In this embodiment, the coiled portion 102 is vertically disposed about the elongated sleeve member 112 and is caged between the flange member 118 and the bottom bifurcated member 12. Further, one arm, preferably such as the first arm 104 which extends from the bottom end of the coiled portion 102 as best shown in FIG. 5, of the coiled torsion spring 100 is supported on a second portion of such coupler head 6 in a fixed fashion for providing a reaction means for the coiled torsion spring 100 and for preventing a free rotational movement of the coiled torsion spring 100 relative to the elongated sleeve member 112.

Alternatively, the elongated sleeve member 112 may be directly attached to the bottom bifurcated member 12 and its bottom end is adapted for having the threaded aperture 114.

Yet alternatively, the elongated sleeve member 112 and the flange 118 may be formed integral with a new knuckle pin 16.

Figure 6:
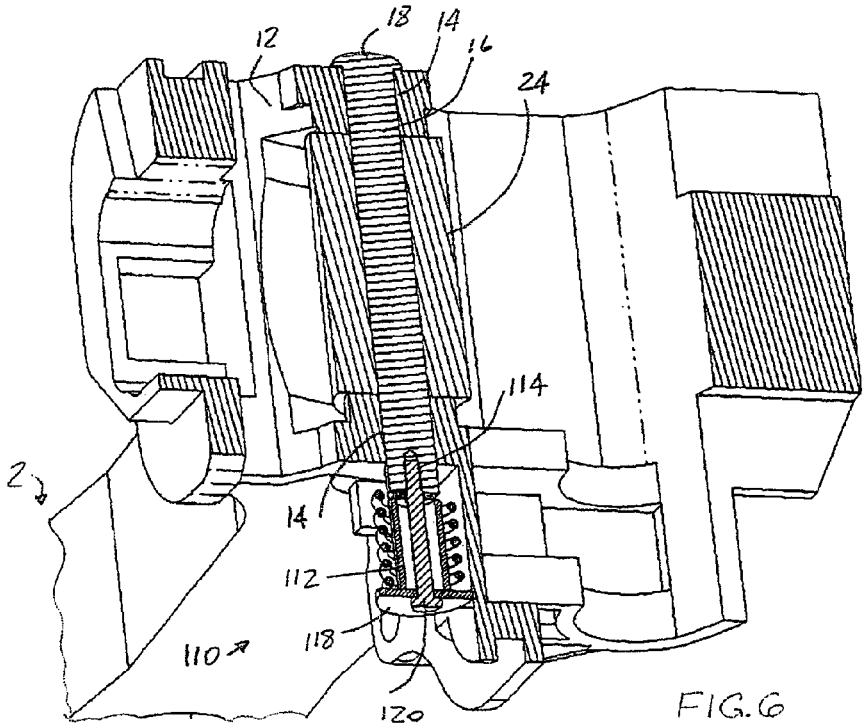
FIG. 6 is a cross-sectional view of the coupler assembly with the improvement apparatus along lines 6-6 of FIG. 5.

The improvement apparatus 30 further includes means, generally designated as 130, for connecting the other arm, preferably the second arm 106, which extends from the upper end of the coil section 102 as best shown in FIG. 6, of the torsion spring 102 to such knuckle 24, thus generating a torque on such knuckle 24 to rotate and maintain the full open position of such knuckle 24. It is presently preferred for such connecting means 130 to include a support member 132 which is rigidly attached to such knuckle 24 and an L-shaped edge notch 134 formed in the support member 132 for caging the second arm 106 of the coiled torsion spring 102.

Alternatively, the connecting means 130 may include a simple aperture 136 formed in a bottom end of such knuckle 24 for receiving a free end of the second arm 106 of the coiled torsion spring 102 which is bent upwardly.

In operation, when the coupling mechanisms (not shown) are coupled, the knuckle 24 closes, thus winding the torsion spring 102, which in turn stores the energy. When a conventional lock (not shown) employed with the coupler assembly 2 is lifted for uncoupling operation and the couplers move apart, the stored energy in the spring 102 opens the knuckle 24 to its full open position and maintains it in such position, making it ready for next coupling operation.

The improvement apparatus 30 may include an optional sensing means 140 which is rigidly attached to a predetermined portion of such coupler head for sensing a position of such knuckle 24. Although, by way of example in FIG. 5, such sensing means 140 is illustrated as a well known proximity sensor 140 which is attached to the bottom bifurcated member 12 for sensing a presence of the support member 132 when the knuckle 24 is rotated into such full open position, other well known sensing means may be employed in the present invention. For example, such sensing means 140 may be a simple switch (not shown) which is engageable with the support member 132 or directly engageable with the knuckle 24.

It will be appreciated that the improvement apparatus 30 constructed according to the second embodiment of the invention can be easily retrofitted on existing coupler systems and does not interfere with normal operations of the coupler when added thereto.

Furthermore, the employment of the coiled torsion spring of the present invention reduces the complexity and costs associated with such retrofit effort relative to the employment of the compression spring.

Thus, the present invention has been described in such full, clear, concise and exact terms as to enable any person skilled in the art to which it pertains to make and use the same. Although the invention has been shown in connection with a certain specific embodiment, it will be readily apparent to those skilled in the art that various changes in form and arrangement of parts and method may be made to suit requirements without departing from the spirit and scope of the invention as set forth in the appended claims.

We claim:

1. In combination with a railway freight car coupler assembly, such coupler assembly including a coupler shank and a coupler head having a knuckle side and a guard arm side, and further including a knuckle pin mounted within such coupler head, and a knuckle which is mounted for independent rotation on such knuckle pin, an apparatus for automatically pivoting and maintaining a full open position of the knuckle of such coupler when a coupling mechanism is actuated, the improvement comprising:

(a) a coiled torsion spring capable of continuously exerting a predetermined force;

(b) an attachment means for attaching said coiled torsion spring to a first portion of such coupler head, said attachment means includes:

i. an elongated sleeve member coaxially engaging a bottom end of such knuckle pin, ii. a threaded aperture axially formed in such bottom end of such knuckle pin, iii. a threaded aperture axially formed in such bottom end of such knuckle pin, iv. a threaded fastener threadably engaging said threaded aperture for securing said elongated sleeve member and said flange member to such bottom end of such knuckle pin, v. whereby said coiled torsion spring is vertically and concentrically disposed about said elongated sleeve member and is caged between said flange member and such first portion of such coupler head, and vi. whereby an opposed second arm of said coiled torsion spring is fixed on a second portion of such coupler head for providing a reaction means for said coiled torsion spring and for preventing a free rotational movement of said coiled torsion spring relative to said elongated sleeve member; and (c) a connecting means for connecting a first arm of said torsion spring to such knuckle generating a torque on such knuckle to pivot and maintain said full open position of such knuckle.

2. The improvement, according to claim 1, wherein said connecting means includes a support member rigidly attached to such knuckle and an L-shaped edge notch formed in said support member for caging said first arm of said coiled torsion spring.

3. The improvement, according to claim 1, wherein said connecting means includes an aperture formed in a bottom end of such knuckle for caging said first arm of said coiled torsion spring.

4. The improvement, according to claim 1, wherein said coiled torsion spring is positioned adjacent a bottom end of such knuckle pin.

5. The improvement, according to claim 1, wherein said improvement further includes a sensing means rigidly attached to a predetermined portion of such coupler head for sensing said full open position of such knuckle.

6. The improvement, according to claim 5, wherein said sensing means is a proximity sensor.

7. In combination with a railway freight car coupler assembly, such coupler assembly including a coupler shank and a coupler head having a knuckle side and a guard arm side, and further including a knuckle pin mounted within such coupler head and a knuckle which is mounted for independent rotation on such knuckle pin, an apparatus for automatically pivoting and maintaining a full open position of the knuckle of such coupler when the coupling mechanism is actuated, the improvement comprising:

(a) a locking means for rigidly securing such knuckle to such knuckle pin to prevent such independent rotation of such knuckle relative to such knuckle pin, thus permitting simultaneous rotational motion of such knuckle and such knuckle pin;

(b) a fixed support member rigidly attached to such coupler head;

(c) a pivot member;

(d) means for securely attaching said pivot member to such knuckle pin for a simultaneous rotation therewith; and (e) a compression member having a first end and a second end, said first end disposed on said fixed support member, whereby said compression member exerts a continuous force onto said pivot member generating a torque on such knuckle pin and such knuckle to pivot and maintain said full open position of such knuckle.

8. The improvement, according to claim 7, wherein said attachment means includes an aperture formed in said pivot member and aligned with an aperture formed in a bottom end of such knuckle pin perpendicular to a longitudinal axis thereof and a fastener means which is received in each cavity.

9. The improvement, according to claim 7, wherein said improvement further includes:

(a) a moveable support member having a connecting end disposed on said second end of said compression member;

(b) said pivot member further having an arm disposed perpendicular to such longitudinal axis of such knuckle pin; and (c) a pivoting means for pivotally connecting said movable support member with said arm of said pivot member.

10. The improvement, according to claim 7, wherein said locking means includes:

(a) an aperture formed in said knuckle perpendicular to a longitudinal axis of such knuckle pin and having a threaded portion;

(b) a cavity complimentary formed in such knuckle pin in alignment with a longitudinal axis of said aperture; and (c) a fastener threadably engaging said threaded portion of said aperture and having an end thereof disposed within said cavity.

11. The improvement, according to claim 7, wherein said improvement further includes a bearing means mounted on such knuckle pin for reducing friction forces generated during said simultaneous rotational motion of such knuckle and such knuckle pin.

12. In combination with a railway freight car coupler assembly, such coupler assembly including a coupler shank and a coupler head having a knuckle side and a guard arm side, and further including a knuckle pin mounted within such coupler head and a knuckle which is mounted for independent rotation on such knuckle pin, an apparatus for automatically pivoting and maintaining a full open position of the knuckle of such coupler when a coupling mechanism is actuated, the improvement comprising:

(a) a coiled torsion spring capable of continuously exerting a predetermined force;

(b) an attachment means for attaching said coiled torsion spring to a first portion of such coupler head; and (c) a connecting means for connecting a first arm of said torsion spring to such knuckle generating a torque on such knuckle to pivot and maintain said full open position of such knuckle, said connecting means including a support member rigidly attached to such knuckle and an L-shaped edge notch formed in said support member for caging said first arm of said coiled torsion spring.

13. The improvement, according to claim 12, wherein said attachment means includes:

(a) an elongated sleeve member coaxially engaging a bottom end of such knuckle pin;

(b) a threaded aperture axially formed in such bottom end of such knuckle pin;

(c) a flange member abutting a bottom end of said elongated sleeve member;

(d) a threaded fastener threadably engaging said threaded aperture for securing said elongated sleeve member and said flange member to such bottom end of such knuckle pin;

(e) whereby said coiled torsion spring is vertically and concentrically disposed about said elongated sleeve member and is caged between said flange member and such first portion of such coupler head; and (f) whereby an opposed second arm of said coiled torsion spring is fixed on a second portion of such coupler head for providing a reaction means for said coiled torsion spring and for preventing a free rotational movement of said coiled torsion spring relative to said elongated sleeve member.

* * * * *